United States Patent [19]

Smirnov et al.

[11] 4,002,550

[45] Jan. 11, 1977

[54] ELECTROLYZER FOR PRODUCING AND REFINING METALS

[76] Inventors: Svetoslav Georgievich Smirnov, Davydkovskaya ulitsa, 22, kv. 88; Nadezhda Semenovna Gorbacheva, Tishinskaya ploschad, 6, kv. 51, both of Moscow; Ljubov Valentinovna Ershova, ulitsa Sadovaya, 13, kv. 48, Boxitogorsk Leningradskoi oblasti; Nina Andreevna Ljubimova, 11 Parkovaya ulitsa, 44, korpus 4, kv. 36, Moscow; Galina Grigorievna Pestova, ulitsa Zavodskaya, 5, kv. 30, Boxitogorsk Leningradskoi oblasti; Nina Pavlovna Selekhova, Bolshaya Cherkizovskaya ulitsa, 6, korpus 9, kv. 61, Moscow; Margarita Ilinichna Smirnova, Bolshaya Cherkizovskaya ulitsa, 6, korpus 9, kv. 61, Moscow; Alexandr Vladimirovich Tiflov, Birjulevskaya ulitsa, 11, korpus 2, kv. 246, Moscow; Nina Alexeevna Fomina, Nagatinskaya naberezhnaya, 18, kv. 92, Moscow, all of U.S.S.R.

[22] Filed: Apr. 15, 1975

[21] Appl. No.: 568,369

[52] U.S. Cl. ..... 204/222; 204/251

[51] Int. Cl.[2] ..... C25C 7/00; C25C 7/02; C25C 7/04

[58] Field of Search ..... 204/219, 220, 260, 263, 204/250, 251, 269, 272, 275, 222

[56] References Cited

UNITED STATES PATENTS

| | | | |
|---|---|---|---|
| 789,721 | 5/1905 | Decker | 204/219 |
| 3,068,165 | 12/1962 | Messner | 204/219 |

*Primary Examiner*—T. M. Tufariello

[57] ABSTRACT

An electrolyzer has an electrolyte tank wherein are accommodated a cathode of the refined metal and an anode of the metal being refined located equidistant from the cathode over shelves of a box-type cross-section arranged in stepped relationship, the shelves being mounted with a clearance relative to the tank inner surface. To circulate the metal there is a pump feeding the metal being refined, from a metal collector situated in the tank bottom, to the top shelf wherefrom the metal flows by gravity over the shelves located therebeneath back into the metal collector. During the circulation of the metal being refined in the electrolyte it dissolves electrochemically and a refined metal deposit is formed on the cathode.

4 Claims, 4 Drawing Figures

ELECTROLYZER FOR PRODUCING AND REFINING METALS

The present invention relates to the art of electrometallurgy and more particularly to electrolyzers for producing and refining metals.

Well known in the art is the electrolyzer for producing and refining gallium, mercury, zinc, bismuth, lead, cadmium, or indium from their liquid alloys comprising an electrolyte tank and accommodated therein receiving means for a metal being refined, these means being in the form of shelves arranged in stepped relationship whereupon the metal being refined and used as an anode is disposed, a cathode of a refined metal positioned equidistant from the anode, leads for the anode and the cathode and a pump to circulate the metal being refined (See, for instance, "Amalgam metallurgy" L. F. Kozin, Technika, 1970, p. 182–188).

In this well known electrolyzer the metal being refined and used as an anode is placed over grooved shelves mounted at a slope on the electrolyzer walls. Between the shelves are provided connecting ducts whose upper portion extends into the bottom of a shelf above, and the metal overflows therethrough from shelf to shelf. From the lower shelf, the metal flows down into a metal collector wherefrom it is fed by a pump to the upper shelf. The shelves carrying the anodic and the cathodic metal are located parallel and opposite each other.

The mounting of shelves filled with metal directly on the electrolyzer tank walls and the presence of the metal at the tank bottom result in continuous contact of the anodic and cathodic metals therewith which causes non-uniform heating of the tank walls and bottom, distortion of the tank and loss of sealing. In addition, the larger the current, the higher is heating of the tank walls and bottom and the more marked become the above adverse effects.

These conditions impose certain limitations on the current increase in the electrolyzer and consequently, on the improvement of the latter productivity.

The well known electrolyzer is capable of operating only with continuous pumping of the metal since should the pump stop all the metal would flow away from the shelves which will lead to ceasing of the electrolysis process.

Moreover, in the well known electrolyzer the anodic metal, in the process of its circulation, can not be cleaned from electrolytic sludge since the openings of the connecting ducts are arranged in the bottom of each shelf whereas the sludge covers the metal surface. This leads to decreasing of the anodic metal surface activity and cutting down the electrolyzer output.

It is therefore an object of the present invention to provide an electrolyzer for producing and refining metals which while having the same volume of the tank and allowing high quality metal to be produced and refined yields a higher output.

The above-mentioned and other objects of the invention are attained by providing an electrolyzer for producing and refining gallium, mercury, zinc, bismuth, lead, cadmium or indium from their liquid alloys, which electrolyzer comprises an electrolyte tank accommodating receiving means for the metal being refined in the form of shelves arranged in stepped relationship whereupon is disposed the metal being refined which is used as an anode, a cathode of refined metal, current leads for the anode and the cathode as well as a pump to circulate the metal being refined. According to the invention the shelves of the receiving means are of a box-type cross section and located horizontally around the cathode with a clearance with respect to the tank inner surface.

It is preferable that each shelf of the receiving means for the metal being refined be made with an overflow lip to enable the metal flow to be directed during overflowing and the sludge to be removed from the metal surface, thereby improving the activity thereof.

It is also preferable to install in the tank a water-cooled diaphragm separating the anode from the cathode which, besides providing protection to the cathodic chamber from penetrating impurities thereinto, permits to control the electrolyte temperature.

It is also preferable that the cathode of the refined metal be placed in a tubular container formed by a cloth filter fastened to a water-cooled frame which makes it possible to considerably reduce the voltage in the electrolizer and consequently, at the same power rating of the supply source, to increase the current, thereby rising the electrolizer productivity.

As a result of the present invention, an electrolyzer is provided allowing, as compared to existing electrolyzers of the same type, to increase productivity several times while producing high quality refined metal.

The invention will be hereinafter described taking by way of example an embodiment thereof and with reference to the accompanying drawings, in which.

Figure 2:
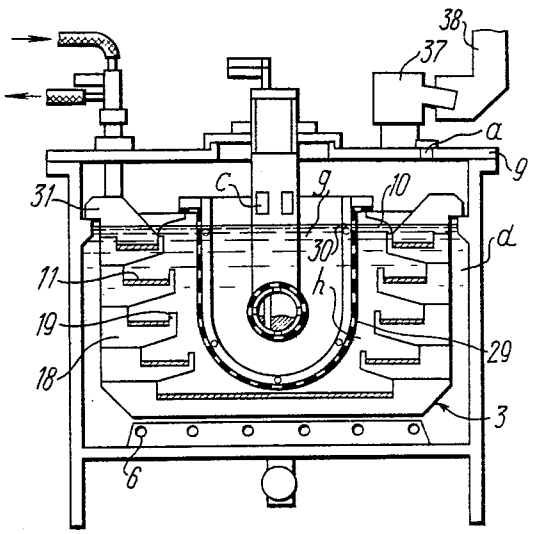
FIG. 2 is a sectional view of the same.
Figure 3:
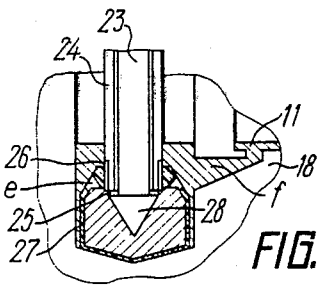
FIG. 3 is an "A" assembly of the FIG. 1; a lower portion of the anodic lead.
Figure 1:
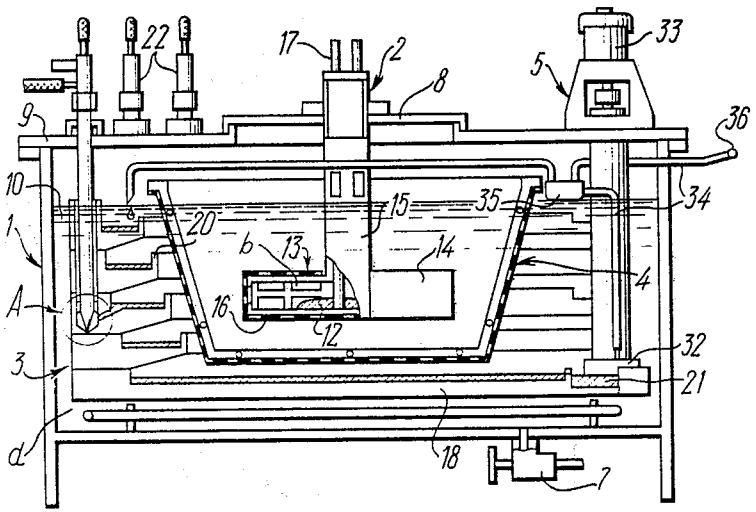
FIG. 1 is an electrolyzer for producing and refining metals made in accordance with the invention (a longitudinal section)

The electrolyzer for refining gallium and mercury shown in FIGS. 1–3 comprises an electrolyte tank 1 with covers which accommodates a tubular container 2 for the refined metal being a cathode, with leads: receiving means 3 for the metal being refined and used as an anode made of a plurality of box cross-section shelves with leads; a diaphragm 4 dividing the tank into anodic and cathodic chambers; a device 5 for circulating of the metal being refined fitted with a pump, metal ducts and a three-way cock; a heat exchanger 6 for heating the electrolyte manufactured of polyethylene tubes and situated near the tank bottom.

The electrolyzer tank 1 is made in organic glass. For the electrolyte discharge, the tank is provided with a valve 7. The tank is closed with covers 8, 9 made of organic glass. In the cover 9 an "*a*" port is provided for pouring an electrolyte 10 and metal 11 being refined into the tank.

The tubular container 2 with the refined metal functioning as the cathode is fixed in the electrolyzer cover 8. The container has a water-cooled frame 13 consisting of a horizontal tube 14 and a vertical hollow bar 15. In the horizontal tube 14 there are "*b*" ports so arranged as to give maximum access to its interior. The horizontal tube of the frame is wrapped over by filter cloth 16 thus forming a container for refined cathodic metal 12. In the upper portion of the bar 15 are provided "c" ports for exhausting cathodic gases from the container 2.

Mounted in the bar 15 are cathodic leads 17 made of tungsten.

The receiving means 3 for the metal 11 being refined are provided in the form of a plurality of shelves 18 arranged in stepped relationship whereupon at an equal distance from the cathode is placed the metal being refined functioning as the anode.

The shelves 18 are of a box cross-section and disposed horizontally with a "d" clearance relative to the tank inner surface. Each shelf has in its wall 19 an overflow lip 20 for directing the metal over the shelf located therebeneath. From the lower shelf, the metal flows down to a metal collector 21.

On each shelf there is mounted an anodic lead 22 whose water-cooled conductor 23 is isolated from the electrolyte by a tube 24 of organic glass and a spacer 25 of fluoroplastic. Water inlet and outlet of the lead are shown by arrows in FIG. 2. Screwed on the tube 24 of the lead 22 over a thread 26 is a tip 27 made of fluoroplastic and having "e" openings through which the metal 11 being refined is fed from the shelves 18 via "f" ducts to a lower end 28 of the conductor 23. The conductor lower end 28 has no insulation and is an active part of the lead.

The water-cooled diaphragm 4 dividing the electrolyzer tank 1 into the cathodic chamber "g" and the anodic one "h" serves to protect the electrolyte 10 of the cathodic chamber from getting impurities thereinto and to control the electrolyte temperature.

The diaphragm 4 is made of filter cloth 29 fastened onto a water-cooled frame 30 and is mounted on brackets 31.

On the lower shelf of the receiving means 3 is installed a pump 32 of the device 5 for pumping the metal being refined over the shelves 18 of the receiving means. The pump 32 with an electric drive 33 is secured to the cover 9 of the electrolyzer. Through metal ducts 34 and via a three-way cock 35 mounted on the top shelf 18 of the receiving means 3, the pump can feed the metal being refined from the metal collector 21 onto the top shelf 18 or into an outside system 36 of metal ducts to empty periodically the electrolyzer from the metal beind refined and clean the latter from impurities accumulated therein.

Gases evoluting in the process of electrolysis are removed via an outlet pipe 37 in the tank cover 9 and exhausted into a ventilation system 38.

The electrolyzer is equipped with automatic control means operated from a control pulpit (not shown) ensuring monitoring and control of a direct current value, the electrolyte temperature and is also provided with an automatic control system for the pump circulating the metal being refined.

The electrolyzer proposed for refining gallium and mercury operates as follows. The tank 1 prepared for the electrolyzer operation is filled with the heated electrolyte 10 to a temperature from 20° to 25° C. Via the heat exchanger 6, hot water (up to 80° C) is supplied to reheat the electrolyte 10 to a temperature of 40°–50° C. Through the "a" port in the tank cover 9, the metal 11 being refined is poured onto the top shelf 18 of the receiving means 11 so that all the shelves 18 should be covered with the metal while some required portion of the metal should be in the pump 32 to circulate and distribute the metal over the shelves. The cathode container 2 is to be filled with an initial portion of the refined metal 12 used as a cathode to provide the cathodic metal surface required.

On the electrolyzer control pulpit, a program is set up to provide a given direct current value, the electrolyte circulation and keeping the electrolyte temperature within the technological parameters.

In the process of electrolysis dissolving of the metal being refined (the anode) and the deposition of the refined metal on the cathode take place.

Impurities, in the main, build up in sludge which is formed in the metal being refined on the shelves 18 of the receiving means. The sludge covers the metal surface and passivates it thereby retarding the process of metal electrolysis. Removing of the sludge from the metal surface is effected by continuous or periodic circulating of the metal being refined which is fed by means of the pump 32 onto the top shelf wherein the metal level rises, and the upper layer saturated with the sludge overflows via the lip 20 onto a shelf located therebeneath and so on. In this way, the surface of the metal disposed on the shelves becomes cleaned thus providing for improving the electrolyzer productivity.

From the bottom shelf 18, the metal flows down into the metal collector 21 wherein after some time the metal contaminated with impurities is accumulated. This metal is periodically removed from the electrolyzer by switching-over the three-way cock 35 into the external system 36 of metal ducts 34 where it is rinsed and filtered, and the electrolyzer is filled up with fresh metal to be refined.

The electrolysis process is carried out continuously. The refined metal accumulated in the cathode container 2 is periodically extracted by a vacuum intake device.

In case of the electrolyzer long-run performance, sludge builds up around the lower end 28 of the anodic leads 22 which results in increased contact resistance in the anodic leads and breakdowns in the electrolyzer operation.

To recover the efficiency of the anodic leads they are to be one by one withdrawn from the electrolyzer together with the metal accommodated inside the tips 27. This metal is drained and passed to a filtering unit whereas the leads after being washed are again mounted in the electrolyzer. It is expedient to perform this procedure during the continuous circulation of the metal being refined so that the metal on the shelves be not de-energized.

A continuous operation of the electrolyzer can make it necessary to change the filter cloth 16 on the container 2 for which purpose with the current switched off, the cathodic leads 17 are withdrawn from the electrolyzer, the container 2 is removed from the tank together with the cover 8 and after the container has been washed its filter cloth is changed. In order to carry out this procedure in a short period of time it is preferable to have a stand-by container 2 with a cover 8.

Upon the installation of a new container and mounting new cathodic leads in the electrolyzer and pouring some initial portion of metal into the container, the direct current is switched on again.

Figure 4:
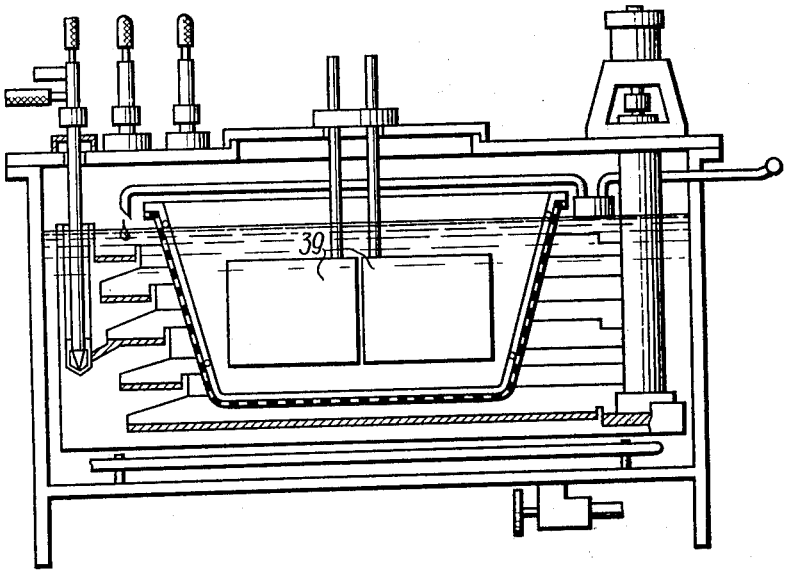
FIG. 4 is a longitudinal sectional view of the electrolyzer for producing and refining metals made in accordance with the invention wherein plates of refined metal are used as a cathode.

When the electrolyzer is employed to produce or refine zinc, bismuth, lead, cadmium or indium from their molten alloys, cathodes in the form of plates 39 (FIG. 4) made of the refined metal are installed in the electrolyzer instead of the container 2.

In the process of electrolysis the refined metal deposits on the cathodes. To obtain this metal, the cathodes are one by one withdrawn from the electrolyzer and the deposited metal is stripped off.

In other respects, the process for producing or refining the above metals is similar to that for producing or refining gallium or mercury.

Commercial test of the proposed electrolyzer have shown that with the high quality of the metal produced or refined in this electrolyzer the productivity thereof is from 2.5 to 3 times higher than that of electrolyzers operated at present in the industry and having the same tank volume.

What we claim is:

1. An electrolyzer for producing and refining a metal from its liquid alloy, comprising: an electrolyte tank closed by covers; a cathode made of a refined metal and having a current lead; a device for holding said cathode in said tank; means for receiving the metal being refined, independent from said tank, and being in the form of a plurality of shelves arranged in a stepped relationship, having a box-shaped cross-section and being installed horizontally about said cathode and with a clearance relative to the inner surface of said tank; an anode made of the metal being refined, disposed over said shelves about said cathode; and a pump to feed the metal being refined from the bottom of said tank to a top shelf of said receiving means; wherein the metal being refined is fed by said pump onto said top shelf, and on flowing by gravity down over said shelves, the metal is dissolved electrochemically in the electrolyte of said tank and is deposited on said cathode as the refined metal.

2. The electrolyzer is defined in claim 1, wherein said shelves are provided with overflow lips.

3. The electrolyzer as defined in claim 1, further comprising a water-cooled diaphragm mounted for separating said anode from said cathode.

4. The electrolyzer as defined in claim 1, wherein said holding device is provided in the form of a tubular container secured to one of said covers of the tank, said container being formed by filter cloth attached to a water-cooled frame.

* * * * *